US009504330B2

(12) United States Patent
Gehner et al.

(10) Patent No.: US 9,504,330 B2
(45) Date of Patent: Nov. 29, 2016

(54) CHAIR

(75) Inventors: Carsten Gehner, Hannover (DE); Heiko Büttner, Hannover (DE)

(73) Assignee: Wilkhahn Wilkening + Hahne GmbH + Co. KG (DE)

( * ) Notice: Subject to any disclaimer, the term of this patent is extended or adjusted under 35 U.S.C. 154(b) by 418 days.

(21) Appl. No.: 13/401,125

(22) Filed: Feb. 21, 2012

(65) Prior Publication Data

US 2012/0256458 A1 Oct. 11, 2012

(30) Foreign Application Priority Data

Apr. 5, 2011 (DE) ..... 10 2011 001 811

(51) Int. Cl.

| | |
|---|---|
| ***A47C 1/00*** | (2006.01) |
| ***A47C 7/14*** | (2006.01) |
| ***A47C 9/00*** | (2006.01) |
| ***A47C 1/032*** | (2006.01) |
| ***A47C 7/44*** | (2006.01) |

(52) U.S. Cl.

CPC ..... *A47C 7/14* (2013.01); *A47C 1/03255* (2013.01); *A47C 1/03272* (2013.01); *A47C 7/443* (2013.01); *A47C 7/448* (2013.01); *A47C 9/002* (2013.01)

(58) Field of Classification Search

CPC ..... A47C 1/03255; A47C 9/002
USPC ..... 297/300.4, 314
See application file for complete search history.

(56) References Cited

U.S. PATENT DOCUMENTS

| | | | | | |
|---|---|---|---|---|---|
| 3,824,991 | A * | 7/1974 | Whitaker | A47C 9/002 | 601/26 |
| 4,025,020 | A * | 5/1977 | Goff | A47C 3/025 | 248/582 |
| 4,988,145 | A * | 1/1991 | Engel | A47C 1/03255 | 297/286 |
| 5,113,851 | A * | 5/1992 | Gamba | A47C 9/002 | 297/330 |
| 5,114,211 | A * | 5/1992 | Desanta | A47C 1/03255 | 297/300.4 |
| 5,409,295 | A * | 4/1995 | Edstrom | A47C 9/002 | 248/372.1 |
| 5,584,533 | A * | 12/1996 | Schrewe | A47C 1/03255 | 297/300.2 |
| 5,588,704 | A * | 12/1996 | Harza | A47C 3/0255 | 297/314 |
| 5,964,503 | A * | 10/1999 | Inoue | A47C 1/03255 | 297/300.1 |
| 5,971,481 | A * | 10/1999 | Emmenegger | A47C 1/03238 | 297/300.4 |

(Continued)

FOREIGN PATENT DOCUMENTS

DE 102007042032 2/2009

*Primary Examiner* — David R Dunn
*Assistant Examiner* — Alexander Harrison
(74) *Attorney, Agent, or Firm* — Renner Kenner Greive Bobak Taylor & Weber

(57) ABSTRACT

A chair includes a seat and a seat mechanism, the seat being coupled to the seat mechanism in such a manner that the seat is, in a front end region, pivotably supported about a first axis of rotation orientated parallel with the axis of a user's knees. In its front end region, the seat is also supported on the seat mechanism so as to be rotatable about a second axis of rotation orientated perpendicularly to the first axis of rotation.

10 Claims, 6 Drawing Sheets

(56) References Cited

U.S. PATENT DOCUMENTS 6,000,755 A * 12/1999 Uhlenbrock ..... 297/300.2
6,015,187 A * 1/2000 Roslund, Jr. ..... A47C 1/03255 297/300.4
6,033,021 A * 3/2000 Udo ..... A47C 9/002 297/217.3
6,056,362 A * 5/2000 de la Haye ..... A47C 3/02 248/394
6,059,363 A * 5/2000 Roslund, Jr. ..... A47C 1/03255 297/301.4
6,068,280 A * 5/2000 Torres ..... A61G 5/045 180/328
6,213,553 B1 * 4/2001 Fitz ..... A47C 9/002 297/195.1
6,494,537 B1 * 12/2002 Lie ..... A47C 1/03255 297/300.4
6,513,874 B1 * 2/2003 Sander et al. ..... 297/300.2
6,523,896 B1 * 2/2003 Uhlenbrock ..... A47C 1/032 297/300.3
6,644,742 B1 * 11/2003 Walser ..... A47C 9/002 248/599
6,869,142 B2 * 3/2005 Heidmann ..... A47C 1/03255 297/300.1
6,913,316 B2 * 7/2005 Kinoshita et al. ..... 297/300.3
7,396,080 B2 * 7/2008 Suhr ..... A47C 3/026 297/313
7,434,881 B1 * 10/2008 Wegener ..... A47C 9/002 297/314
7,637,570 B2 12/2009 Becker et al.
7,717,513 B2 * 5/2010 Ueda ..... A47C 7/443 297/300.2
7,806,479 B2 * 10/2010 Jensen ..... A47C 9/002 248/158
8,029,060 B2 * 10/2011 Parker ..... A47C 1/023 297/300.1
8,177,299 B2 * 5/2012 Fukai ..... A47C 1/032 297/300.2
8,348,341 B2 * 1/2013 Hsiao ..... 297/300.4
2002/0043846 A1 * 4/2002 Brauning ..... A47C 3/026 297/314
2002/0158495 A1 * 10/2002 Kazuyoshi ..... A47C 1/03238 297/300.4
2002/0180252 A1 * 12/2002 Kinoshita ..... A47C 1/03238 297/463.1
2003/0080596 A1 * 5/2003 Berman ..... A47C 7/14 297/314
2004/0245828 A1 * 12/2004 Norman ..... A47C 1/023 297/300.4
2005/0146185 A1 * 7/2005 Fookes ..... A47C 1/03255 297/300.4
2006/0006715 A1 * 1/2006 Chadwick ..... A47C 1/03255 297/300.4
2006/0138834 A1 * 6/2006 Wegener ..... A47C 9/002 297/314
2007/0273190 A1 * 11/2007 Gehner ..... 297/300.2
2008/0088163 A1 * 4/2008 Sander ..... A47C 1/03255 297/300.4
2008/0169693 A1 * 7/2008 Becker ..... A47C 7/28 297/299
2010/0109402 A1 * 5/2010 Masunaga ..... A47C 1/026 297/300.4
2014/0191550 A1 * 7/2014 Katoh ..... B60N 2/48 297/337
2015/0245713 A1 * 9/2015 Desanta ..... A47C 1/032 297/316

* cited by examiner

CHAIR

TECHNICAL FIELD

The invention relates to a chair having a seat and a seat mechanism, the seat being coupled to the seat mechanism in such a manner that the seat is, in a front end region, pivotably supported about a first axis of rotation which is orientated parallel with the axis of a user's knees.

BACKGROUND OF THE INVENTION

U.S. Pat. No. 7,637,570 discloses a chair having a seat and a seat mechanism, the seat mechanism permitting a lateral pivoting movement of the seat, and the seat and the seat mechanism being in such a form that one side of the seat is movable independently of the other side of the seat during the lateral pivoting movement of the seat. Furthermore, both sides of the seat are pivotably supported about an axis of rotation which is orientated parallel with the axis of a user's knees.

In contrast to the concepts followed hitherto, in the case of which the entire seat and especially the entire seating face tilt to the right or to the left as a rigid element, in the chair known from U.S. Pat. No. 7,637,570 the right-hand and left-hand side of the seat are movable independently of each other. Such a chair is capable of following the user in his natural three-dimensional movements and nevertheless of offering sufficient security when the posture is straight.

In a preferred configuration of this new concept, the seat mechanism has two lateral support arms which react independently of each other and on which the seat is supported in its front and rear region by means of ball-and-socket joints.

SUMMARY OF THE INVENTION

An object of the present invention is to provide an alternative configuration of this new concept of movement.

According to the invention, that object is achieved by the features of claim 1.

The chair according to the invention has a seat and a seat mechanism, the seat being coupled to the seat mechanism in such a manner that the seat is, in a front end region, pivotably supported about a first axis of rotation orientated parallel with the axis of a user's knees. Furthermore, in its front end region, the seat is additionally supported on the seat mechanism so as to be rotatable about a second axis of rotation orientated perpendicularly to the first axis of rotation.

Owing to the second axis of rotation, a defined lateral pivoting movement of the seat can be produced.

Further configurations of the invention are the subject-matter of the subordinate claims.

In a preferred form of the invention, the seat mechanism permits a lateral pivoting movement of the seat, the seat and the seat mechanism being in such a form that one side of the seat is movable independently of the other side of the seat during the lateral pivoting movement of the seat. It may be provided in particular that the lateral pivoting movement of the seat results in a rotation of the seat about the second axis of rotation.

In a further configuration of the invention, the seat mechanism has two lateral support arms which react independently of each other and to which the seat is coupled in a rear region. The two support arms can be pivoted especially about a pivot axis which is orientated parallel with the first axis of rotation and which is arranged below the front end region of the seat. The distance between the first axis of rotation of the seat and the pivot axis of the support arms is especially from 2 to 8 cm, preferably from 3 to 5 cm.

In addition, the front end region of the seat can be supported on the seat mechanism by way of at least one plain bearing provided between the seat and the seat mechanism.

Furthermore, the seat may comprise a seating face and a backrest, the support arms being coupled to the seat in a lower region of the backrest.

Owing to the connection of the seat to the support arms, it is possible to set a desired synchronous ratio of the seat inclination to the backrest inclination which is determined, on the one hand, by the distance between the pivot axis of the support arms and the coupling between the support arms and the backrest and, on the other hand, by the distance of the pivot axis of the support arms from the first axis of rotation of the seat.

Further advantages and configurations of the invention will be explained in greater detail hereinafter with reference to the description and the drawings.

BRIEF DESCRIPTION OF ILLUSTRATIVE EMBODIMENTS

Figure 1C:
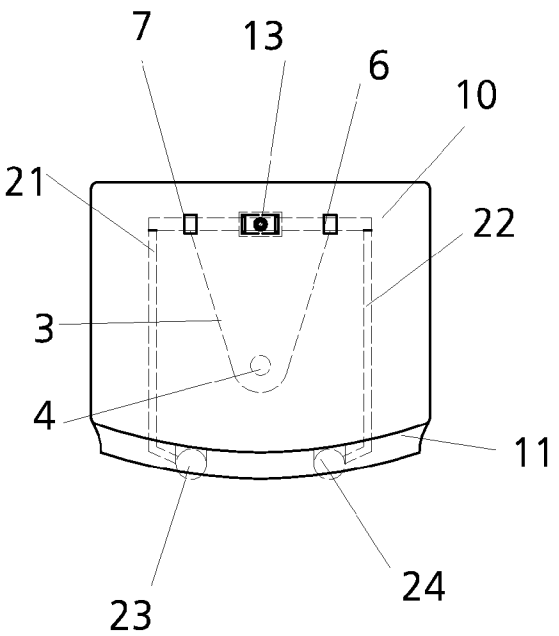
FIG. 1*c* is a plan view of the chair according to FIG. 1*a*.
Figure 1B:
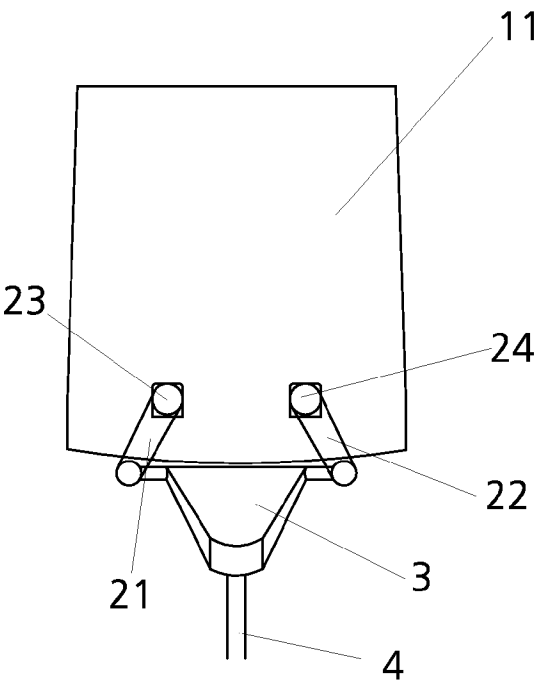
FIG. 1*b* is a rear view of the chair according to FIG. 1*a*.

FIGS. 1*a*-1*e* show a chair in an upright position, which chair may be, for example, a revolving office chair. It substantially comprises a seat 1 and a seat mechanism 2. The seat 1 in turn has a seating face 10 and a backrest 11 which are movable relative to each other. The relative movability may be formed by a suitable pivoting or bending zone, it being possible for the seating face 10 and the backrest 11 to be formed both in one piece and also by separate parts.

The seat mechanism has a base support 3 which is secured to a foot frame 4, which may be in any desired configuration, and which is used to support the seat 1. In the embodiment shown, the seating mechanism 2 further comprises two lateral support arms 21, 22 which react independently of each other and to which the seat 1 is coupled in a rear region 1*b*, especially in a lower region of the backrest 11. Suitable connections are especially ball-and-socket joints 23, 24 which are supported in corresponding receiving members on the backrest 11. The support arms 21, 22 are pivotable about a pivot axis 25 which is supported on the base support 3 and which is arranged below the front end region 1*a* of the seat 1. The seat 1 is pivotably supported about a separate axis of rotation 12 in its front region 1*a*, the distance a between the first axis of rotation 12 and the pivot axis 25 of the support arms being from 2 to 8 cm, preferably from 3 to 5 cm.

The chair can also be brought from its upright position shown in FIGS. 1*a*-1*e* into a position inclined backwards according to FIGS. 2*a*-2*d* by the user displacing his weight backwards.

Figure 1A:
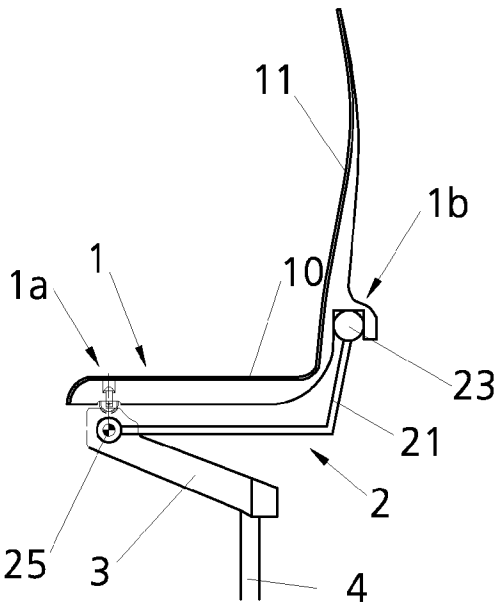
FIG. 1*a* is a schematic side view of the chair according to the invention in an upright position.
Figure 1E:
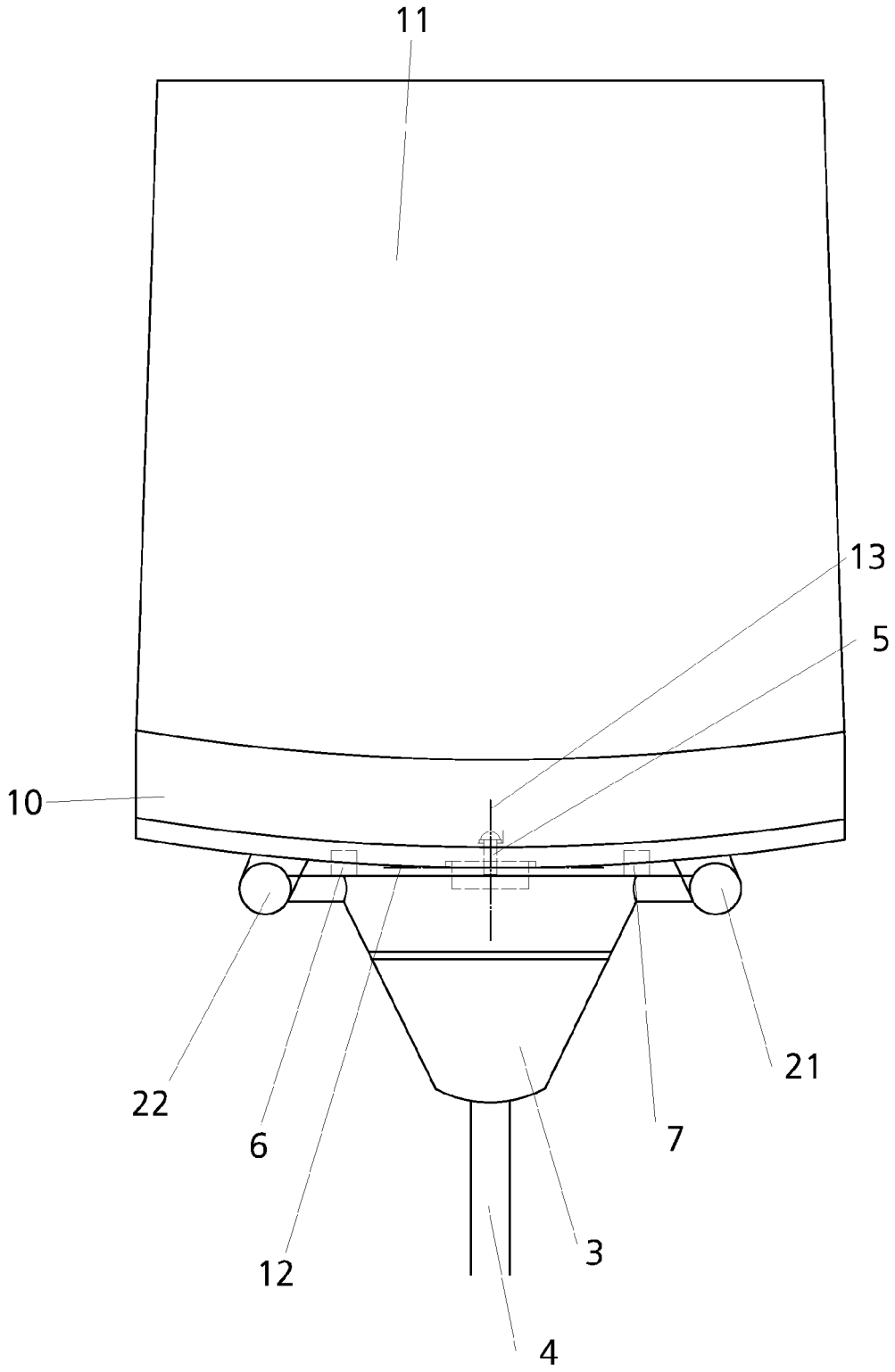
FIG. 1*e* is a front view of the chair according to FIG. 1*a*.
Figure 2C:
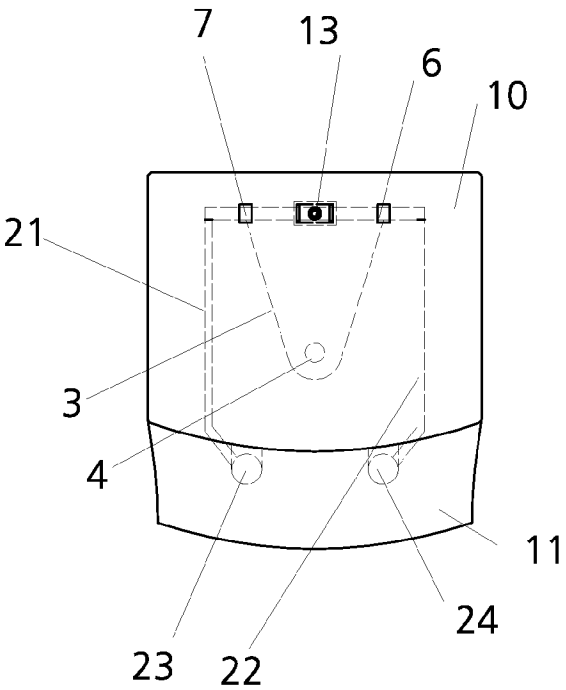
FIG. 2*c* is a plan view of the chair according to FIG. 2*a*.
Figure 2B:
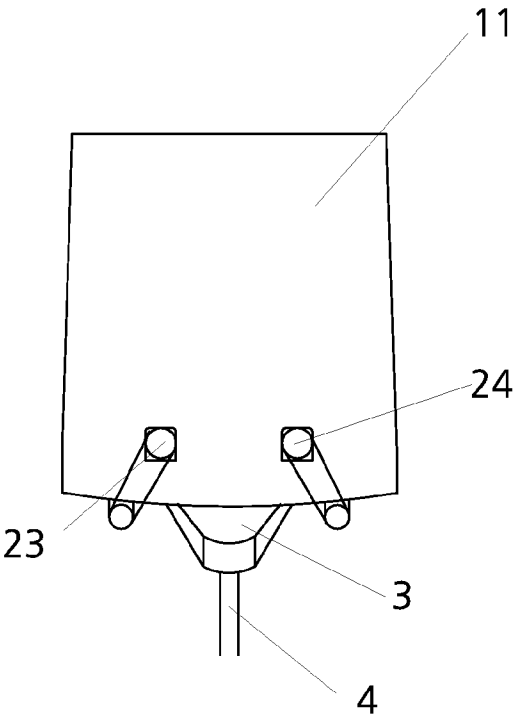
FIG. 2*b* is a rear view of the chair according to FIG. 2*a*.
Figure 2A:
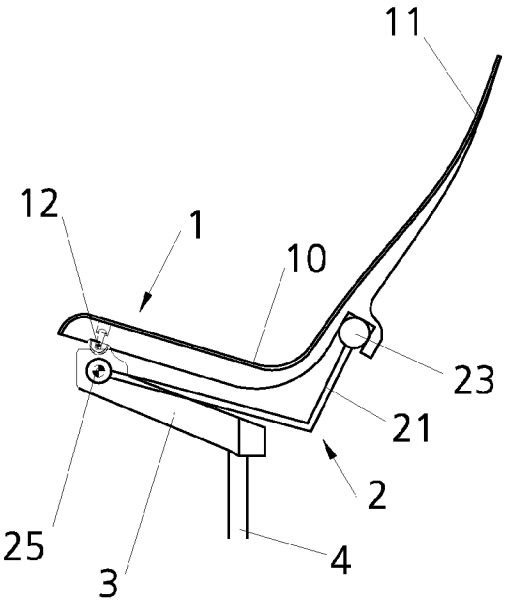
FIG. 2*a* is a schematic side view of the chair according to the invention in a position inclined backwards.
Figure 1D:
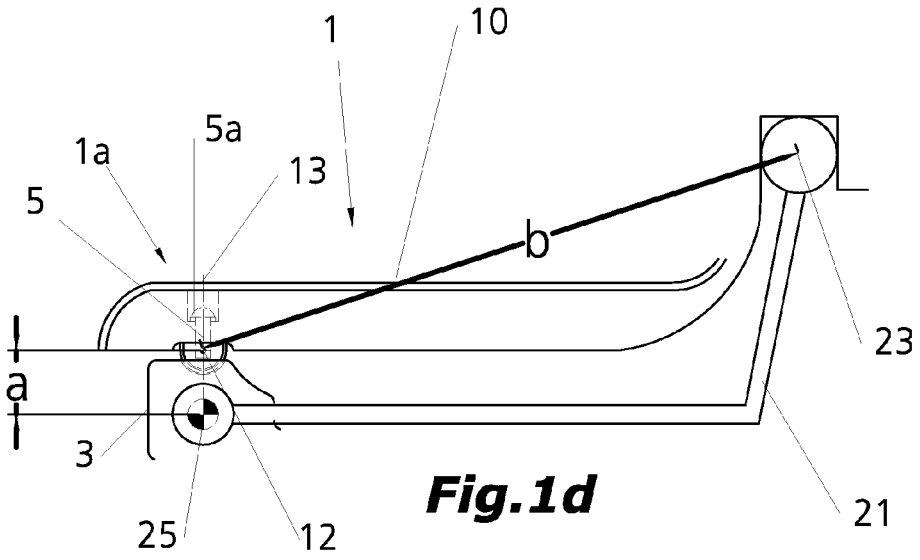
FIG. 1*d* is an enlarged detailed view of the connection between the seat and the seat mechanism in the position of the chair according to FIG. 1*a*.
Figure 2D:
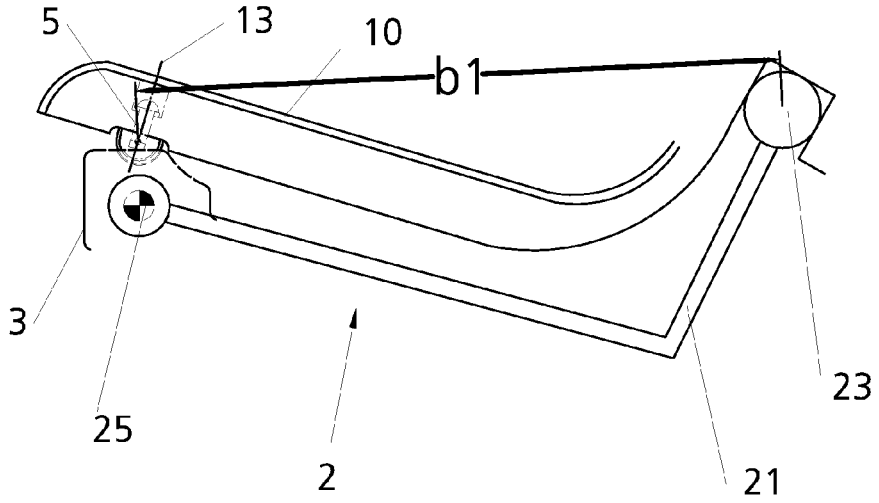
FIG. 2*d* is an enlarged detailed view of the connection between the seat and the seat mechanism in the position of the chair according to FIG. 2*a*.

As can be seen by comparing FIG. 1*a* and FIG. 2*a*, this results in a pivoting movement of the support arms 21, 22 about their pivot axis 25 and a pivoting movement of the seat 1 about its first axis of rotation 12. The seat 1 is clamped securely between its first axis of rotation 12 and the ball-and-socket joints 23, 24 fitted to the rigid support arms 21, 22. Owing to the distance a (see FIG. 1*d*) between the first axis of rotation 12 and the pivot axis 25 of the support arms, the distance b, $b_1$ between the first axis of rotation 12 and the ball-and-socket joints 23 and 24 (see FIG. 1*d* and FIG. 2*d*) is increased when there is a pivoting movement from the upright position according to FIG. 1*a* into the position inclined backwards according to FIG. 2*a*.

Since, however, the seat 1 is clamped securely between the first axis of rotation 12 and the ball-and-socket joints 23, 24, a relative movement occurs between the seating face 10 and the backrest 11 in that the angle between the seating face 10 and the backrest 11 increases. During this movement of the seat, consequently, on the one hand an inclination of the seat and, on the other hand, an inclination of the backrest take place. The ratio of the seat inclination to the backrest inclination is usually referred to as a synchronous ratio, a synchronous ratio of 1 to 2 being found to be particularly pleasant. Accordingly, the backrest inclination, measured relative to the floor, is twice as great as the seat inclination. This synchronous ratio can be set, on the one hand, by the distance between the pivot axis 25 of the support arms and the coupling between the support arm and the backrest (position of the ball-and-socket joints 23, 34) and, on the other hand, by the distance a of the pivot axis 25 of the support arms from the first axis of rotation 12 of the seat.

In the region of their pivot axis 25, the support arms 21, 22 cooperate with at least one suitable resilient member, for example a torsion or helical spring, so that the support arms always urge the seat into the upright position according to FIG. 1*a*. The resilient member is advantageously provided with suitable adjusting means in order to be able to adapt the chair to the actual weight of a user. Further adjusting means, such as, especially, a system for locking the chair in the upright position, are possible.

The seat mechanism described above consequently enables the seat to be pivoted about an axis of rotation orientated parallel with the axis of a user's knees and arranged in the front region of the seat. In a further configuration of the invention, the seat 1 is further supported in the front end region 1*a* thereof on the seat mechanism 2 or on the base support 3 so as to be rotatable about a second axis of rotation 13 orientated perpendicularly to the first axis of rotation 12.

In the embodiment shown, the second axis of rotation 13 is located in the middle of the seat 1 in its front end region 1*a*. In the upright position according to FIGS. 1*a*-1*e*, the first and the second axes of rotation 12, 13 intersect with each other. The pivot axis 25 and the second axis of rotation 13 also intersect in that position. It would, however, also be quite possible for the three axes to be arranged offset relative to each other.

In the embodiment shown, the two axes of rotation 12, 13 of the seat 1 are formed by a pin 5 which is supported so as to be pivotable about the first axis 12 and which at the same time enables the seat 10 to rotate about the longitudinal axis of the pin which forms the second axis of rotation 13. In the embodiment shown, the pin 5 has a projecting head 5*a* and is connected securely at its other end to a sliding block which is guided in the base support 3 in the manner of a sliding block guide in order to perform the pivoting movement about the first axis of rotation 12, as can be seen from FIGS. 1*d*, 1*e* and 2*d*.

The seat 1 is thus clamped in the seat mechanism in the region of the pin 5 in its front region and by the two ball-and-socket joints 23, 24 in its rear region. Owing to the rigid support arms 21, 22, a rotational movement of the seat 1 about the second axis of rotation 13 is consequently possible only in conjunction with a simultaneous pivoting movement of the seat about the first axis of rotation 12. The pivoting movement of the seat 1 about the first axis of rotation 12 can thus be overlaid with a lateral pivoting movement of the seat. This means, for example, that the left-hand rear end of the seating face 10 is inclined downwards further than the right-hand rear end. Owing to the connection of the seating face 10 and the backrest 11, the backrest 11 therefore also follows such a lateral movement. As a result, the user experiences comfortable support by the backrest even when a lateral pivoting movement backwards occurs.

In order to ensure sufficient lateral stability, especially also in the upright position of the chair, the seat 1 is supported in its front region by way of two plain bearings 6, 7 on the seat mechanism 2 or the base support 3. In the embodiment shown, a plain bearing 6, 7 is in each case provided to the side of the pin 13 between the base support 3 and the seat 1 (see FIGS. 1*c* and 1*e*).

Figure 3C:
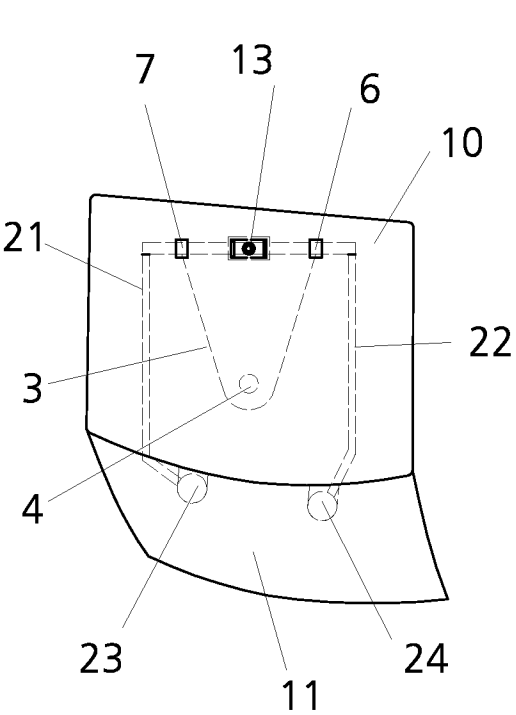
FIG. 3*c* is a plan view of the chair according to FIG. 3*a*.
Figure 3B:
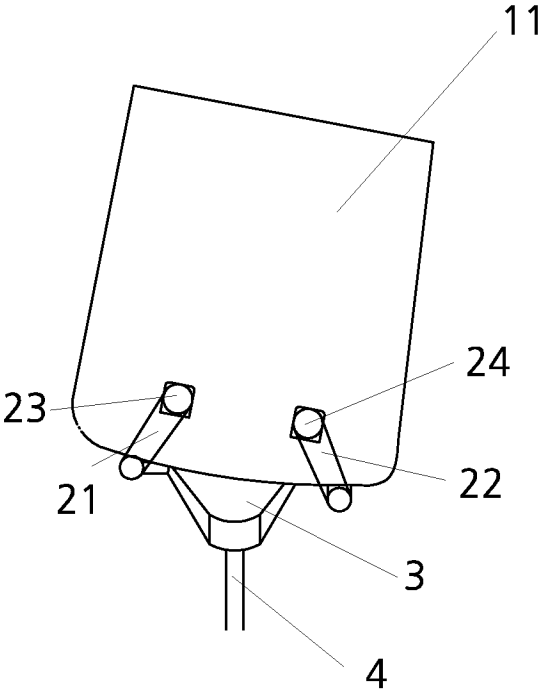
FIG. 3*b* is a rear view of the chair according to FIG. 3*a*.
Figure 3A:
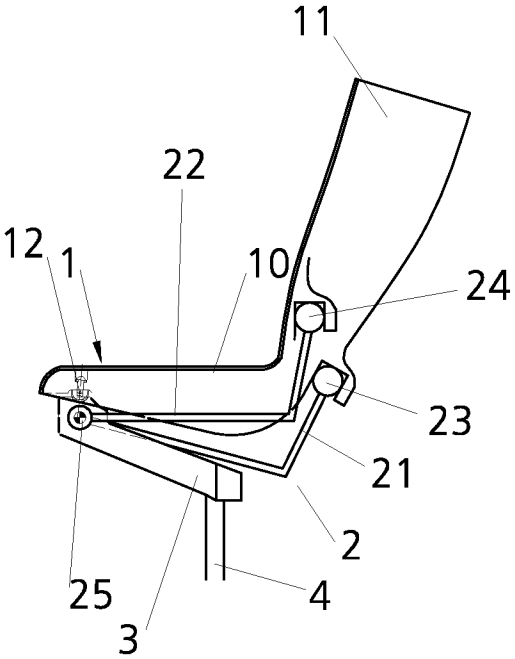
FIG. 3*a* is a schematic side view of the chair according to the invention in a laterally inclined position.

FIGS. 3*a*-3*c* show the situation in which the right-hand side of the seat 1 performs a lateral pivoting movement independently of the left-hand side of the seat. A relative movement occurs between the seat 1 and the plain bearings 6, 7, as can be seen especially from FIG. 3*c*. In order to be able to perform that movement, the seat has a corresponding twisting capability.

Owing to the defined clamping of the seat 1 between the fixing points (pin 5 and ball-and-socket joints 23, 24), it is possible to adjust an exact synchronous ratio of the seat inclination to the backrest inclination. Furthermore, the chair can be inclined not only straight back but also to one of the two sides. In each position of the chair, a sufficiently strong pressure from the backrest 11 acts on the user's back, so that he feels securely supported in each position.

Figure 4A:
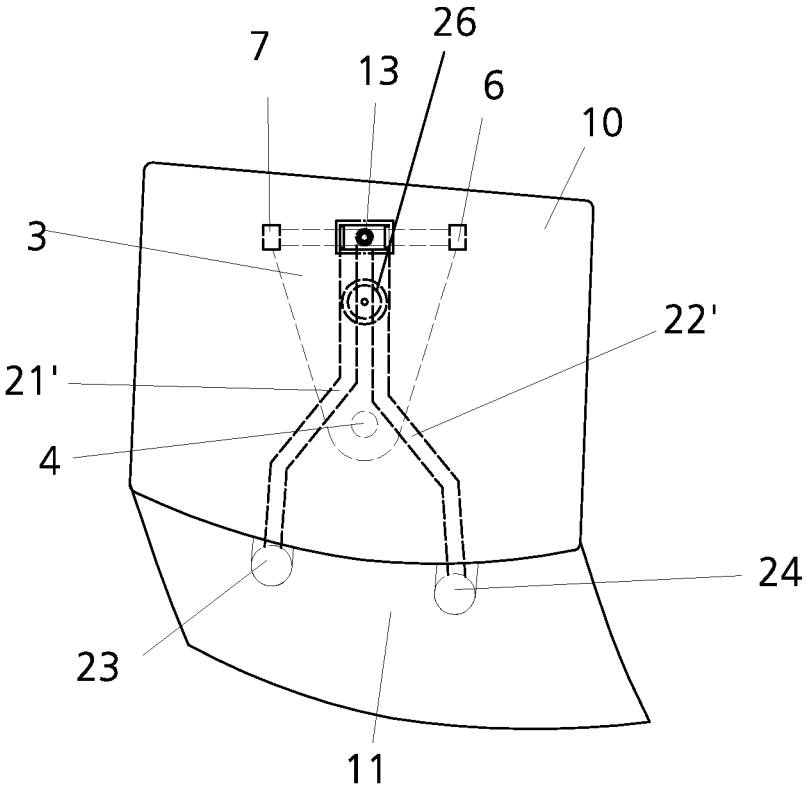
FIG. 4*a* is a schematic plan view of a chair in a laterally inclined position with alternative springing and FIG. 4*b* is a schematic side view of the chair according to FIG. 4*a*.
Figure 4B:
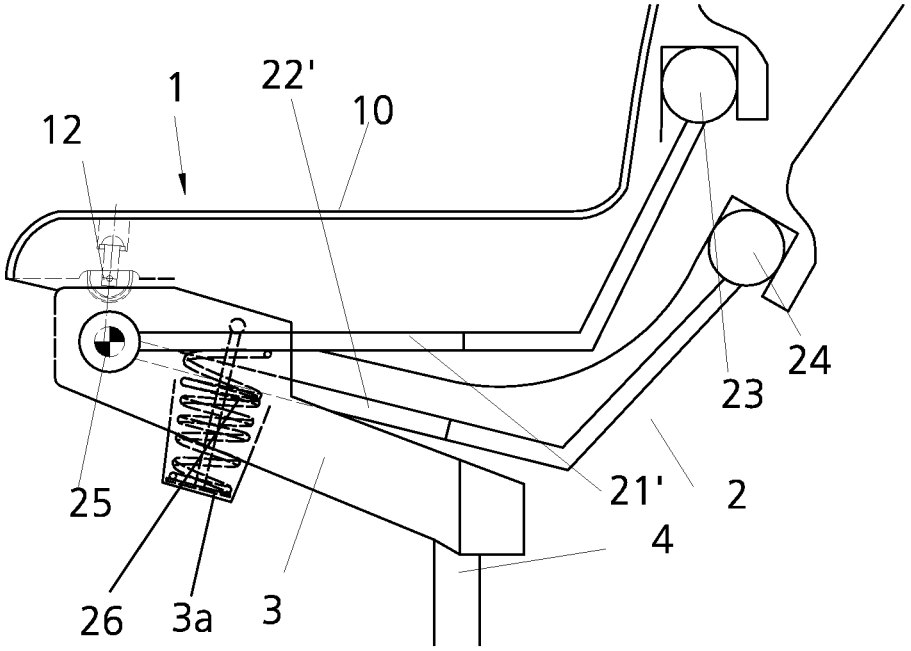

The embodiment according to FIGS. 4*a* and 4*b* also shows a position of the chair in a laterally inclined position (similarly to FIGS. 3*a*-3*c*). Here, however, the support arms 21', 22' cooperate with a resilient member 26 in the form of a helical spring. In the front half, the support arms 21', 22' are in a form bent at right-angles to each other in such a manner that the two support arms are in this region arranged parallel with each other and at a relatively small distance from each other. Arranged below this region is the resilient member 26 which is supported by one end on a counter-bearing 3*a* on the base support and which is in contact with the two support arms 21', 22' by its other end, it being possible for the support arms to press in the resilient member 26 together or also independently of each other when rotation occurs about the pivot axis 25. In the context of the invention, a respective resilient member could of course also be associated with each pivot arm.

The invention claimed is:

1. A chair comprising:

a seat having a seat face for sitting upon; and a seat mechanism, the seat being coupled to the seat mechanism in such a manner that the seat is, at a front end of the seat face, pivotably supported about a first axis of rotation, which is orientated parallel with the axis of a user's knees to permit reclining of the seat, wherein the seat is, in the lateral middle of the front end, secured to the seat mechanism so as to define a second axis of rotation orientated perpendicularly to the seat face and perpendicularly to the first axis of rotation, the seat being rotatable about the second axis of rotation, and wherein the seat mechanism permits a lateral pivoting movement of the seat, the seat and the seat mechanism being in such a form that one side of the seat is movable independently of the other side of the seat during the lateral pivoting movement of the seat face about the second axis of rotation.

2. The chair according to claim 1 wherein the seat mechanism has two lateral support arms which react independently of each other and to which the seat is coupled in a rear region.

3. The chair according to claim 2, wherein the two support arms are pivotable about a pivot axis which is orientated parallel with the first axis of rotation and which is arranged below the front end of the seat.

4. The chair according to claim 3, wherein the distance between the first axis of rotation and the pivot axis is from 2 to 8 cm.

5. The chair according to claim 2, wherein the seat comprises a seating face and a backrest, the support arms being coupled to the seat in a lower region of the backrest.

6. The chair according to claim 5, wherein the synchronous ratio of the seat inclination to the backrest inclination is determined, by both the distance between the pivot axis of the support arms and the coupling between the support arm and the backrest, and by the distance of the pivot axis of the support arms from the first axis of rotation of the seat.

7. The chair according to claim 1, wherein the second axis of rotation is formed so as to be fixed in position on the seat mechanism.

8. The chair according to claim 1, wherein the front end of the seat is supported on the seat mechanism by way of at least one plain bearing provided between the seat and the seat mechanism.

9. The chair according to claim 1 wherein the seat is, in the middle of its front end, secured to the seat mechanism by a pin defining both the first axis of rotation and the second axis of rotation.

10. The chair according to claim 9, wherein a longitudinal axis of the pin forms the second axis of rotation.

* * * * *